US006412155B2

(12) United States Patent
Fleissner

(10) Patent No.: US 6,412,155 B2
(45) Date of Patent: Jul. 2, 2002

(54) DEVICE FOR HYDRODYNAMIC SUPPLY OF THE FLUID TO FIBERS OF A FIBER WEB

(75) Inventor: Gerold Fleissner, Zug (CH)

(73) Assignee: Fleissner GmbH & Co., Maschinenfabrik, Egelsbach (DE)

( * ) Notice: Subject to any disclaimer, the term of this patent is extended or adjusted under 35 U.S.C. 154(b) by 0 days.

(21) Appl. No.: 09/781,999

(22) Filed: Feb. 14, 2001

(30) Foreign Application Priority Data

Feb. 15, 2000 (DE) ..... 100 06 763

(51) Int. Cl.[7] ..... D04H 1/48

(52) U.S. Cl. ..... 28/104; 28/167; 28/105; 26/18.6

(58) Field of Search ..... 26/18.5, 18.6; 28/104, 105, 103, 116, 122, 134, 135, 136, 137, 165, 167

(56) References Cited

U.S. PATENT DOCUMENTS 2,730,933 A * 1/1956 Reynolds ..... 92/38
4,003,783 A * 1/1977 Groome et al. ..... 26/18.6
4,072,557 A * 2/1978 Schiel ..... 26/18.6
5,031,289 A * 7/1991 LeRoy et al. ..... 28/107
5,704,102 A * 1/1998 Catallo ..... 26/18.6
5,761,778 A * 6/1998 Fleissner ..... 28/104
5,960,525 A * 10/1999 Fleissner ..... 28/104
6,055,710 A * 5/2000 Fleissner ..... 28/104
6,058,583 A * 5/2000 Takeuchi et al. ..... 28/104

* cited by examiner

*Primary Examiner*—Amy B. Vanatta
(74) *Attorney, Agent, or Firm*—Antonelli, Terry, Stout & Kraus, LLP

(57) ABSTRACT

A device is known in which the bulky nonwoven arriving on a continuous belt for water needling is slowly compressed between a needling drum and another belt and at the same time is wetted by a first water curtain from the nozzle bank; its water jets first flow through the continuous belt and then the fiber web and ultimately the needling drum. There is a simpler and thus more economically producible device of this type when instead of the needling drum this compacting unit consists only of two continuous belts which however should be guided such that at the inlet the two working sides of the continuous belts slowly compact and press the incoming nonwoven, and then the belts lying on one another are moved past the nozzle bank as they are held pressed. Additional deflection rollers are used for this purpose.

14 Claims, 4 Drawing Sheets

DEVICE FOR HYDRODYNAMIC SUPPLY OF THE FLUID TO FIBERS OF A FIBER WEB

BACKGROUND OF THE INVENTION

EP-A-0 959 076 discloses a device for hydrodynamic entwining for preferably binder-free compaction of the fibers of a fiber web of natural and/or artificial fibers of any type. It consists of a) a first continuous belt which supports the fiber web and which is routed under tension between at least two rollers and is deflected, b) a permeable needling drum which is looped by the continuous belt, c) a second continuous belt which is likewise routed under tension between at least two rollers being assigned in the opposite direction to the first continuous belt; the working side of the second belt which is opposite the working side of the first continuous belt turns driven in the same direction as that of the first continuous belt, furthermore, d) the two working sides of the two continuous belts in their lengthwise extension at the inlet are pointed conically towards one another so that the fiber web which lies on the working side of the first continuous belt is increasingly compressed between the continuous belts which are running ahead, e) the two continuous belts are pressed by the two rollers against the needling drum for stronger looping of the drum and f) between these two rollers a nozzle bank for wetting of the fiber web is pointed against the fiber web which is held compressed between the two continuous belts.

A device of this type has the advantage that the fiber web which runs ahead in terms of bulk is compressed increasingly slowly between the two continuous belts and with uniform pressure from the top and bottom without shear stress and only when it is held securely between the two continuous belts is it wetted on the needling drum. The nonwoven is pressed more strongly against the needling drum by the two rollers in front of and behind the nozzle bank. This stronger compression, or more correctly, the better holding of the fibers of the fiber web during wetting prevents floating of the individual fibers and ultimately leads to a better nonwoven product.

The device has proven itself in practice, it is characterized especially by intensive wetting which is produced uniformly on the drum, and then after diversion of the second from the first continuous belt, by needling which is still possible on the drum by means of a second nozzle bank which is now pointed directly against the fiber web which lies on the drum. But the construction is very complex and too expensive for many products. The object of the invention is a simpler construction which meets the same conditions.

SUMMARY OF THE INVENTION

To achieve this object, the invention calls for a device for hydrodynamically exposing the fiber web to a fluid for preferably binder-free compaction of the fibers of a fiber web of natural and/or artificial fibers of any type, which consists of a) a first continuous belt which supports the fiber web and which is routed under tension between at least two rollers and is deflected, b) a second continuous belt in the opposite direction which is likewise routed under tension between at least two rollers and which is assigned to the first continuous belt; the working side of the second continuous belt which is opposite the working side of the first continuous belt turns driven in the same direction as that of the first continuous belt, c) the two working sides of the two continuous belts in their lengthwise extension at the inlet being pointed conically towards one another so that the fiber web which lies on the working side of the first continuous belt is increasingly compressed between the continuous belts which are running ahead, d) a first nozzle bank which is assigned to the two continuous belts which turn with one another for wetting of the fiber web, for example, and e) preferably in the case of using the device also as a compaction unit following this belt compacting unit, at least one more nozzle bank which is assigned directly to for example a continuous belt which continues to run with the fiber web lying thereon, and f) the first continuous belt especially in the area of the first nozzle bank being pressed by at least one additional deflection roller against the directly assigned side of the second continuous belt or vice versa the second being pressed against the first continuous belt for stronger contact pressure of the two continuous belts which are running ahead with one another.

This device makes it possible to increasingly press and thus compact the nonwoven to be wetted between the continuous belts and then also continue to hold it securely, similarly to the device as claimed in EP-A-0 959 076. Therefore, what matters here is slow compacting and fixing, holding securely preferably even thin nonwoven between the belts during exposure to the first water jets. This is given in the device known beforehand, where the continuous belts in water needling are pressed against the needling drum. In this new device the needling drum is omitted and needling takes place more easily only between the two working sides of the continuous belts. They can however yield to the pressure of the water jets. To solve this problem, the continuous belts in the area of the nozzle bank must be held in an exactly guided manner. This can be achieved with only one or better two additional deflection rollers.

The objective in the addition to the device as claimed in the invention is achieved when this additional deflection roller for the two continuous belts is shifted into the plane of the side which is running ahead such that on the latter, depending on the desired contact pressure, a looping angle which is larger or smaller for the continuous belts is formed. Therefore it must be greater than 1 degree and in practice is between 5 and 35, up to 45 degrees.

BRIEF DESCRIPTION OF THE DRAWINGS

Several devices of the type as claimed in the invention are shown by way of example in the drawings.

DETAILED DESCRIPTION OF THE PREFERRED EMBODIMENTS

Figure 1:
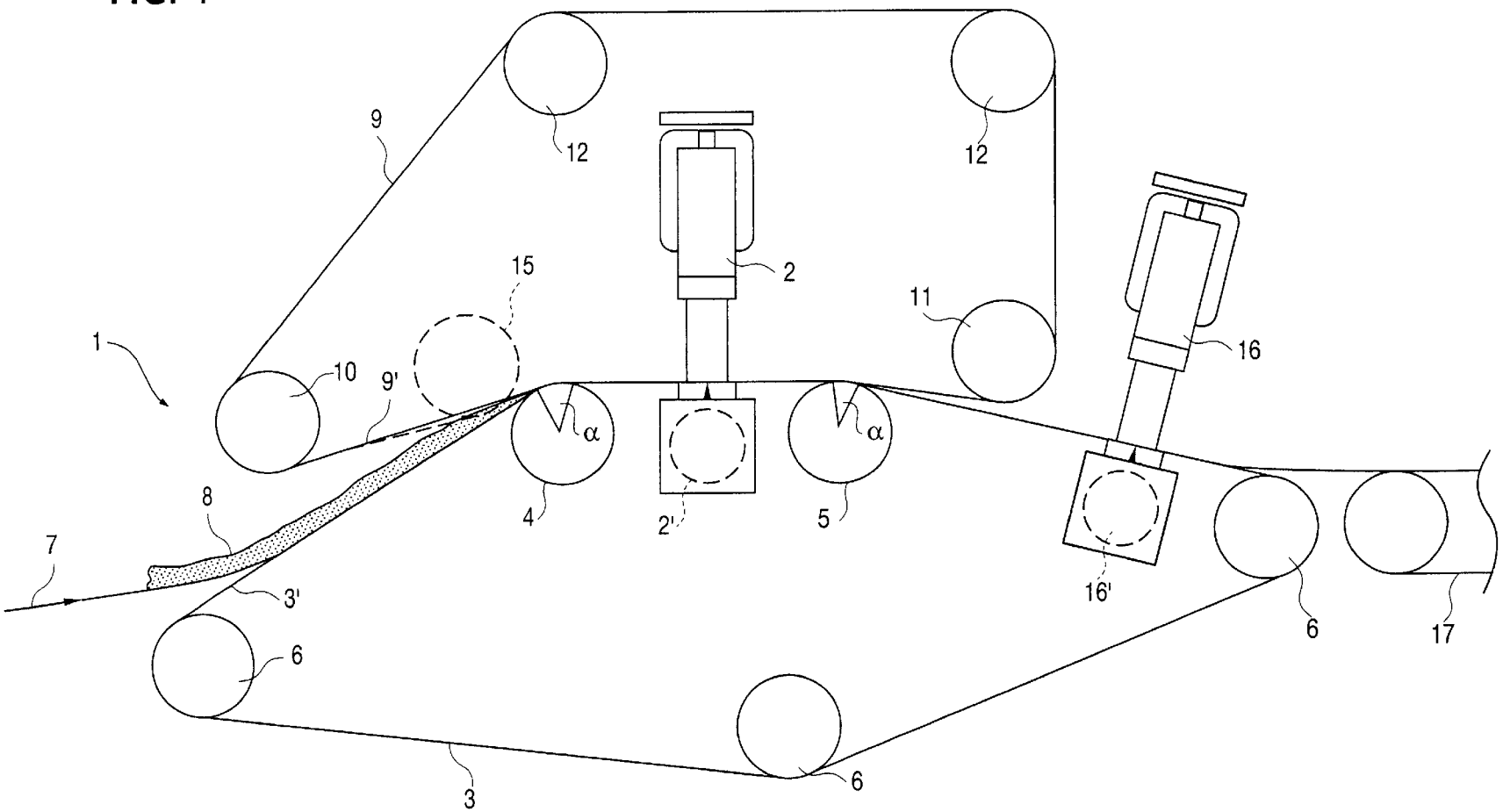
FIG. 1 shows in a side view a compacting unit with two deflection rollers which are offset in the same direction to the top for pressing the continuous belts.

In a frame which is not shown there is a compacting unit 1 with only one nozzle bank 2 with suction 2'. This unit 1 is normally the first unit of a larger water needling system in which therefore several other for example belt needling units can be connected.

Basically this unit 1 consists of a first continuous belt 3 which is held under tension and deflected via several rollers 4, 5, 6 which are pivotally located in another holding frame which is not shown. In the direction of the arrow 7 an initially more bulky fiber web 8 to be needled runs onto this continuous belt. There can also be a fiber web which is very thin and is in this respect provided with initially no strength and thus is deposited by a carder, which is not shown, directly onto the continuous belt 3.

A second continuous belt 9 is assigned in the opposite direction to the first continuous belt 3 such that the working side 3' of the first continuous belt 3 is opposite the working side 9' of the second continuous belt, there the sides 3', 9' turn in the same direction and run conically onto one another in this area. This is in turn caused by several rollers 10–12 of the continuous belt 9 which are pivotally mounted on the indicated frame.

Two of the rollers of the first continuous belt 3, specifically the rollers 4 and 5, tension the continuous belt 3 against the continuous belt 9; its working side 9' is held under tension between the rollers 10, 11. This means that the rollers 4 and 5 press the continuous belt 3' which is routed under tension against the continuous belt 9' from underneath. Thus the continuous belts 3', 9' do not touch the deflection rollers 4, 5, but they are looped with the contact pressure angle $\alpha$. They are located tightly next to one another and between themselves leave so much space that the nozzle bank 2 with the suction 2' has enough room. In this way the delivered fiber web which is carried to the front by the side 3' of the continuous belt 3 is compacted slowly not only between the continuous belts 3 and 9, but is held pressed during wetting. In addition, the continuous belts in the area of the suction 2' are supported to the bottom so that the belts 3', 9' cannot yield to the pressure of the water jets.

Figure 2:
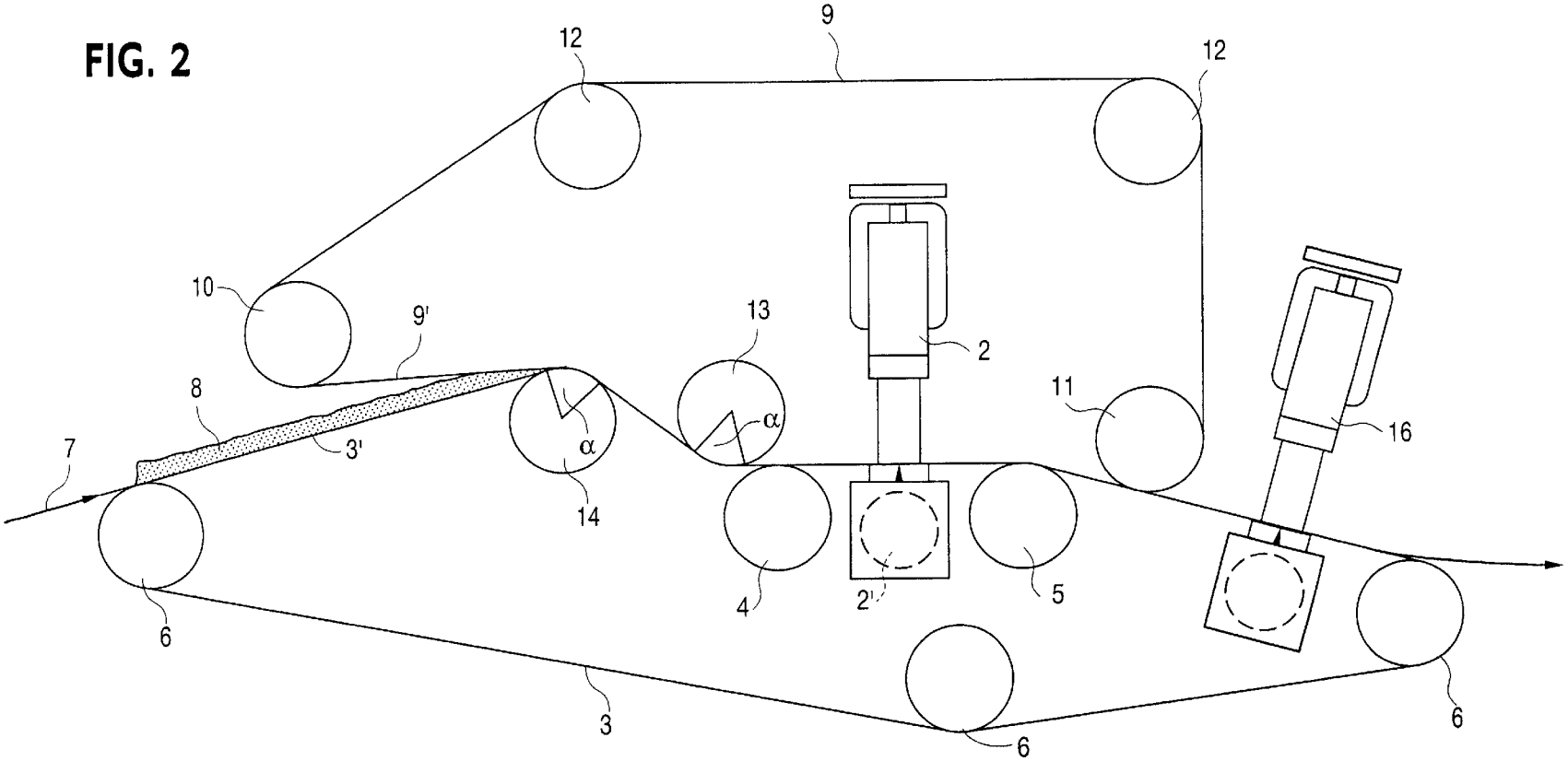
FIG. 2 shows the device as shown in FIG. 1 with furthermore two deflection rollers which move in the opposite direction and around which the belts are looped in a meander.

The same principle is retained when, as shown in the embodiment as shown in FIG. 2, there are two additional rollers 13, 14 above and below the continuous belts 3', 9' in front of the nozzle bank 2 and they hold the two continuous belts 3', 9' between themselves and are then shifted against one another such that the two rollers 13, 14 are looped in a meander by the continuous belts 3', 9' with the contact pressure angle $\alpha$. The roller 4 can support the continuous belt 3' underneath directly in front of the nozzle bank 2, 2'. In this embodiment a higher contact pressure against the nonwoven will form.

Figure 3:
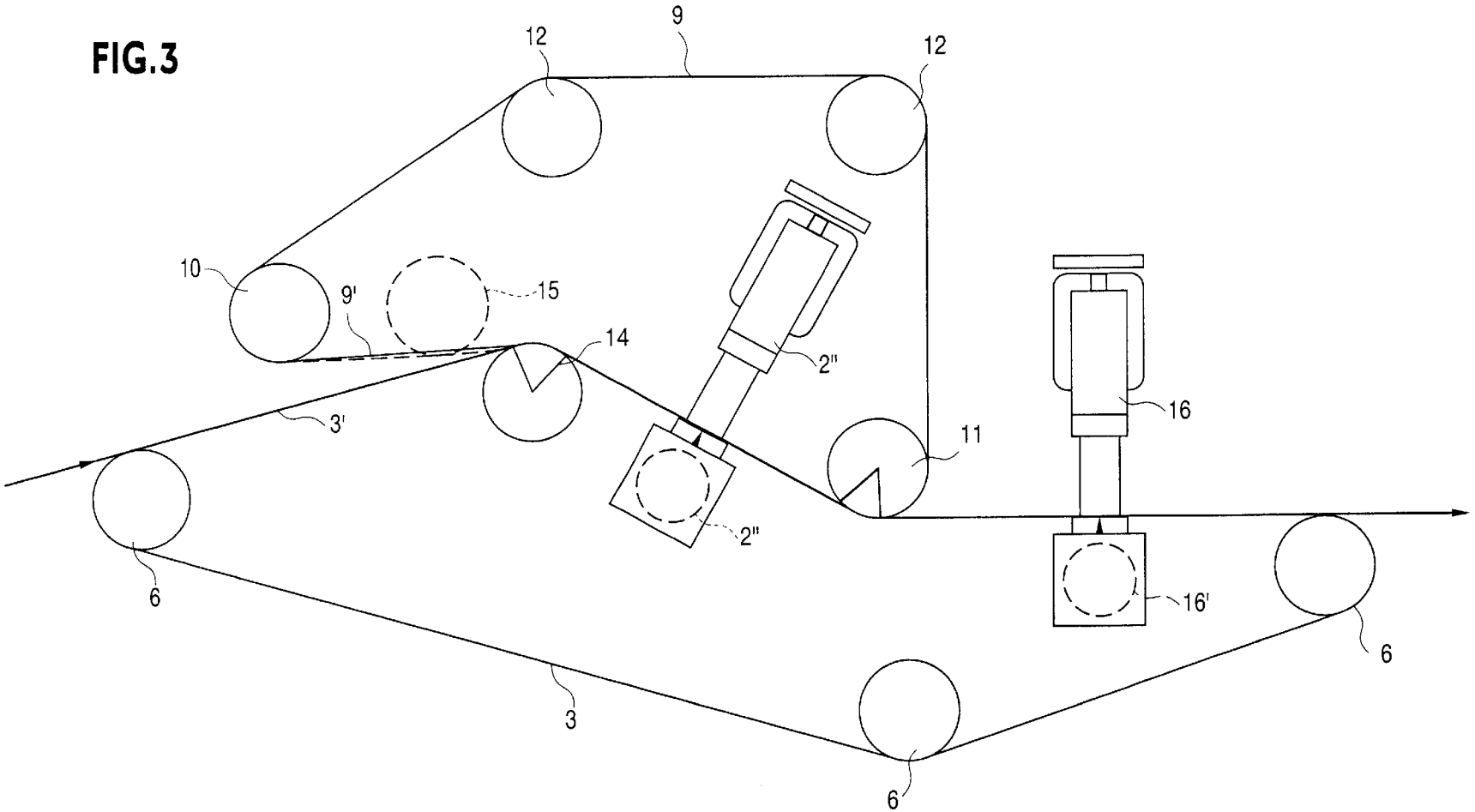
FIG. 3 shows a device similar to the one shown in FIG. 2, but with a nozzle bank which is located between the deflection rollers which are looped in a meander.

In the device as claimed in FIG. 3 the deflection rollers 13, 14 are arranged somewhat away from one another in the holding frame, at this point the rollers 14, 11 and the nozzle unit 2", 2''' are located between these deflection rollers 14, 11. There can be another deflection roller 15 to the roller 14 above the belts 3', 9' for further pressing of the incoming nonwoven. This also applies to FIG. 1, where this roller 15 is likewise optionally shown.

Figure 4:
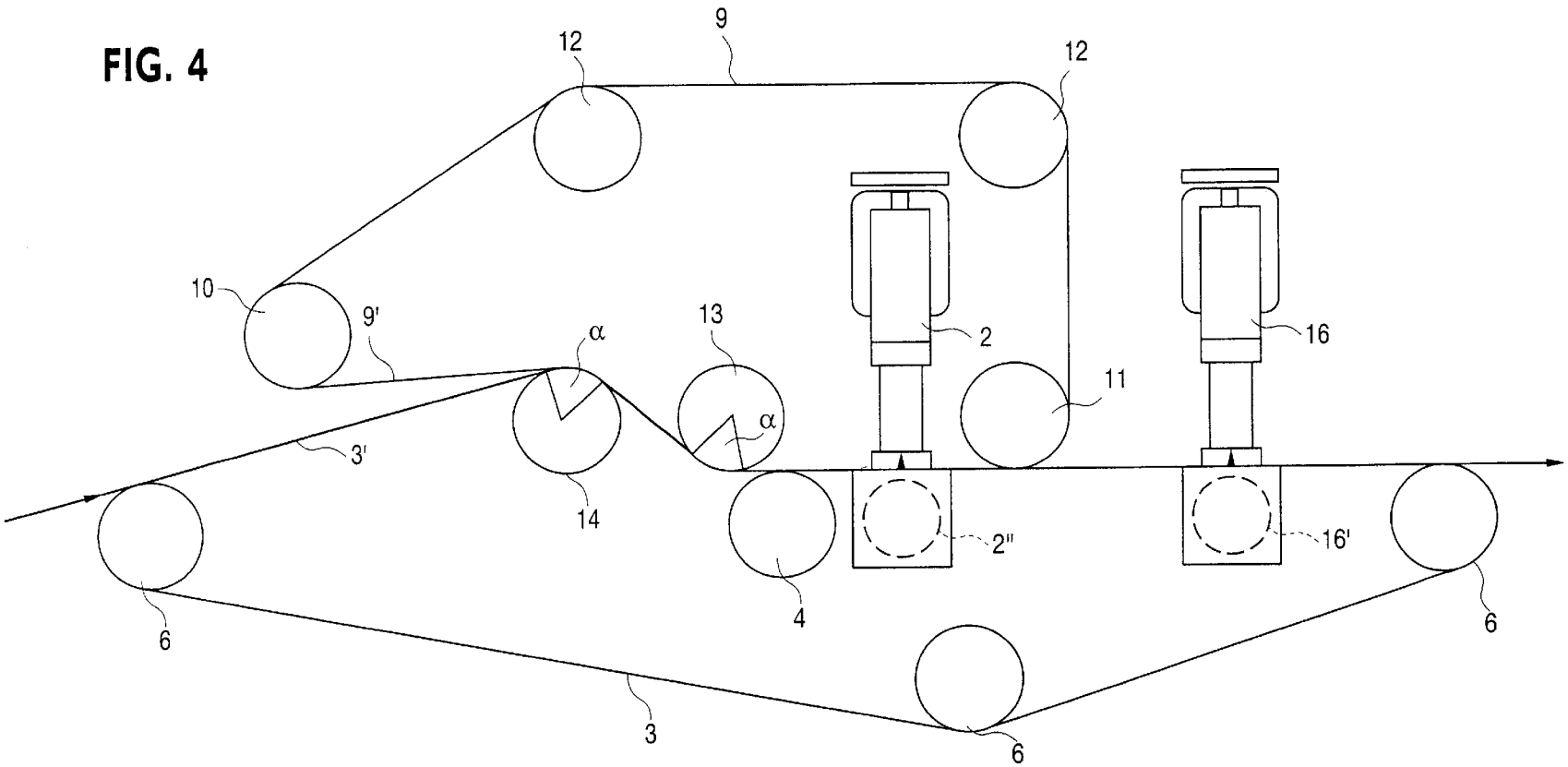
FIG. 4 shows an only partially different structure compared to the device shown in FIG. 2.

In FIG. 4 the belt support rollers 5 are omitted so that the device can be built to be somewhat more compact.

In all embodiments another nozzle bank 16 with suction 16' is assigned to the compacting unit 1 and it is intended for the wetted nonwoven which lies freely on the first continuous belt 3' for direct needling. Therefore the top second continuous belt 9 is deflected upward beforehand so that the nonwoven is not further covered at the top. The nozzle bank 16 should in any case be assigned to the first continuous belt 3 so that the nonwoven has greater strength prior to removal from the belt 3. Other needling means 17 can follow. Here pure belt needling or also one with needling drums is possible.

What is claimed is:

1. Device for hydrodynamically exposing a fiber web to a fluid for compaction of the fibers of the fiber web, comprising:

a first continuous belt to support the fiber web, the first continuous belt being routed under tension between at least two rollers and deflected, a second continuous belt opposed to the first continuous belt and routed under tension between at least two rollers, a working side of the second continuous belt being opposed to a working side of the first continuous belt and being driven in the same direction as that of the first continuous belt, the working sides of the two continuous belts in their lengthwise extension at the inlet being pointed conically towards one another so that the fiber web which is to lie on the working side of the first continuous belt is increasingly compressed between the continuous belts which are running ahead, a first nozzle bank for wetting the fiber web compressed between the two continuous belts, the first nozzle bank being provided at an area in which the two continuous belts are under tension but not deflected by a roller, and at least one additional deflection roller for pressing the first continuous belt against the working side of the second continuous belt for stronger contact pressure of the two continuous belts.

2. Device for hydrodynamically exposing a fiber web to a fluid for compaction of the fibers of the fiber web, comprising:

a first continuous belt to support the fiber web, the first continuous belt being routed under tension between at least two rollers and deflected, a second continuous belt opposed to the first continuous belt and routed under tension between at least two rollers, a working side of the second continuous belt being opposed to a working side of the first continuous belt and being driven in the same direction as that of the first continuous belt, the working sides of the two continuous belts in their lengthwise extension at the inlet being pointed conically towards one another so that the fiber web which is to lie on the working side of the first continuous belt is increasingly compressed between the continuous belts which are running ahead, a first nozzle bank for wetting the fiber web compressed between the two continuous belts, the first nozzle bank being provided at an area in which the two continuous belts are under tension but not deflected by a roller, and at least one additional deflection roller for pressing the second continuous belt against the working side of the first continuous belt for stronger contact pressure of the two continuous belts.

3. Device as claimed in claim 1 or 2, wherein the at least one additional deflection roller is shifted from a plane of the first and second continuous belts at the location at which the first nozzle bank is provided such that the first and second continuous belts form a looping angle on the at least one additional deflection roller which is more than one degree.

4. Device as claimed in claim 1 or 2, wherein two additional deflection rollers are provided and the first nozzle bank is located between the additional deflection rollers.

5. Device as claimed in claim 1 or 2, wherein two successive additional deflection rollers are provided and are looped in a meander by the two continuous belts.

6. Device as claimed in claim 5, wherein the first nozzle bank is located in the transport direction behind the two successive additional deflection rollers.

7. Device as claimed in claim 1 or 2, wherein two deflection rollers are assigned directly to the nozzle bank.

8. Device as claimed in claim 7, further comprising suction means provided on an opposite side of the two continuous belts opposed to the first nozzle bank, wherein the two deflection rollers are provided on either side of the suction means supporting the first continuous belt.

9. Device as claimed in claim 7, wherein the two deflection rollers are located both on the top and also on the bottom of the two working sides of the continuous belts.

10. Device as claimed in claim 7, wherein a third deflection roller or support roller is provided in the area of the nozzle bank.

11. Device as claimed in claim 1 or 2, wherein the nozzle bank is located vertically between and in the area of the deflection rollers.

12. Device as claimed in claim 1 or 2, wherein the nozzle bank is located obliquely between and in the area of the deflection rollers.

13. Device as claimed in claim 1 or 2, wherein another nozzle bank is provided for wetting the fiber web to be provided on the first continuous belt after the first continuous belt is diverted away from second continuous belt.

14. Device as claimed in claim 3, wherein the looping angle is 5–45 degrees.

* * * * *